US006718928B2

(12) United States Patent
Brueggen et al.

(10) Patent No.: US 6,718,928 B2
(45) Date of Patent: Apr. 13, 2004

(54) METHOD FOR STARTING A MULTI-CYLINDER INTERNAL COMBUSTION ENGINE

(75) Inventors: Gerhard Brueggen, Starzach (DE); Nikolaus Benninger, Vaihingen (DE); Udo Sieber, Bietigheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/018,877

(22) PCT Filed: Feb. 7, 2001

(86) PCT No.: PCT/DE01/00461

§ 371 (c)(1),
(2), (4) Date: Dec. 26, 2001

(87) PCT Pub. No.: WO01/81760

PCT Pub. Date: Nov. 1, 2001

(65) Prior Publication Data

US 2002/0157630 A1 Oct. 31, 2002

(51) Int. Cl.[7] ..... F02N 17/00

(52) U.S. Cl. ..... 123/179.5; 123/179.17; 123/90.15

(58) Field of Search ..... 123/179.3, 179.4, 123/179.5, 179.17, 90.11, 90.15, 179.1

(56) References Cited

U.S. PATENT DOCUMENTS

| | | | | |
|---|---|---|---|---|
| 4,854,272 A | * | 8/1989 | Konno | 123/90.17 |
| 5,219,397 A | | 6/1993 | Jones | |
| 5,752,478 A | * | 5/1998 | Sono et al. | 123/90.11 |
| 6,050,231 A | * | 4/2000 | Tisch et al. | 123/179.5 |
| 6,050,232 A | | 4/2000 | Volz et al. | |

FOREIGN PATENT DOCUMENTS

| | | |
|---|---|---|
| DE | 3117144 | 11/1982 |
| JP | 63 198779 | 12/1988 |
| WO | WO 99 20882 | 4/1999 |

* cited by examiner

*Primary Examiner*—Henry C. Yuen
*Assistant Examiner*—Arnold Castro
(74) *Attorney, Agent, or Firm*—Walter Ottesen

(57) ABSTRACT

The invention relates to a method for starting a multi-cylinder internal combustion engine (1), especially of a motor vehicle. The position of a piston (2) in a cylinder (3) of the engine (1) is determined and fuel is injected into a combustion chamber (4) of that cylinder (3) whose piston (2) is disposed in a work phase. In order to make possible a start of the internal combustion engine (1) as reliable as possible without an electro-motoric starter, it is suggested that the inlet and/or outlet valves (5) of at least one cylinder (3), whose piston (2) is disposed after top dead center (TDC), is brought into a position corresponding to a work phase in advance of the starting operation.

16 Claims, 3 Drawing Sheets

METHOD FOR STARTING A MULTI-CYLINDER INTERNAL COMBUSTION ENGINE

FIELD OF THE INVENTION

The present invention relates to a method for starting a multi-cylinder internal combustion engine, especially of a motor vehicle wherein the position of a piston in a cylinder of the engine is determined. Fuel is injected into a combustion chamber of that cylinder whose piston is in a work phase.

The invention furthermore relates to a multi-cylinder internal combustion engine, especially of a motor vehicle. The internal combustion engine includes a detector device for determining the position of a piston in a cylinder of the engine and a fuel metering system for injecting fuel into a combustion chamber of that cylinder whose piston is in a work phase. Finally, the present invention relates also to a control apparatus for such a multi-cylinder internal combustion engine, especially of a motor vehicle.

BACKGROUND OF THE INVENTION

A method for starting a multi-cylinder internal combustion engine of the kind described above is known, for example, from DE 31 17 144 A1. The method described therein operates without an electric-motoric starter. At standstill of the engine, a quantity of fuel, which is necessary for a combustion, is injected and ignited in the combustion chamber of one or several cylinders whose piston is disposed in the work phase. Thereafter, fuel is injected and ignited in each of the combustion chamber(s) of the cylinders whose pistons execute the next work stroke as soon as the particular piston has reached the work position. In this way, the internal combustion engine can be configured without an electric starter and the components necessarily associated therewith. In addition, an electric storage battery of the engine can be dimensioned smaller because this battery no longer has to supply energy for the starter and the other electrical components.

In the known method for starting an internal combustion engine, the stroke (compression stroke, work stroke, discharge stroke, induction stroke) in which the individual pistons of the engine and the inlet and outlet valves of the combustion chamber are disposed must be precisely observed. This has the consequence that, in a 4-cylinder or 6-cylinder engine, for each stroke of the engine, only the combustion chamber of a single cylinder (namely, of the cylinder whose piston is in the work position) can be filled with fuel and the fuel can be ignited. The known method is limited to internal combustion engines wherein, on the one hand, the compression stroke, work stroke, discharge stroke and induction stroke are run through in a fixed sequence per cylinder and wherein, on the other hand, the distribution of the strokes to the individual cylinders is fixedly pregiven.

As a further state of the art, reference is made U.S. Pat. No. 6,050,232 A1 from which likewise a method is known for starting an internal combustion engine without an electric starter.

SUMMARY OF THE INVENTION

The present invention has the task of starting a multi-cylinder internal combustion engine without an electric starter in the simplest possible way, rapidly and yet reliably.

For solving this task, the invention proceeds from the method of the art mentioned initially herein and suggests that the inlet and/or outlet valves of at least one cylinder whose piston is disposed after top dead center is brought into a position corresponding to a work phase in advance of the start operation.

The method of the invention includes, for example, a camshaft-free control of the inlet and/or outlet valves. In this way, each inlet valve and outlet valve can be driven separately from the other valves and independently of the position of the camshaft. For a camshaft-free control, the inlet and/outlet valves are equipped individually or several in common with an actuator element. The actuator element can be operated hydraulically, piezoelectrically, electromagnetically, or in another way. A plurality of camshaft-free controls for the inlet and outlet valves are known from the state of the art, which can be utilized in combination with the present method according to the invention.

Alternatively, the method according to the invention includes, for example, a variable camshaft positioning device on the inlet end in order to adjust an early inlet closure of the inlet valve. The inlet camshaft can be so displaced that the inlet valves are opened in the induction phase only at the start for a short time and are thereby brought into a position corresponding to the work phase. In this way, an earlier inlet closure can be adjusted at the inlet end.

In the method according to the invention, the valves can be independently and, insofar as the free movement of the valve permits, freely opened or closed. In this way, it is achieved to change from an induction phase into a work phase and vice versa in advance of or during the starting operation. In the same manner, the change from a compression phase to a discharge phase and vice versa, is possible.

With the method of the invention, it is possible for the first time in a four or six-cylinder engine, at the beginning of the start operation, to bring two cylinders into the position corresponding to the work phase. Fuel is injected simultaneously into the combustion chambers of these two cylinders and the air/fuel mixture is simultaneously ignited. The double combustion leads to an especially intense start acceleration of the crankshaft and therefore to an especially short start operation. The double combustion offers adequate reserve in order to reliably overcome possible friction and compression resistances at the beginning of the start operation.

Fuel is then injected into the combustion chamber of a further cylinder disposed in the compression phase and the compressed air/fuel mixture is ignited. The injection begin in the combustion chamber of the additional cylinder can, if the injection pressure is high enough, be shifted into the advancing compression phase until shortly before reaching top dead center. Because of the second combustion, the rotational movement of the crankshaft is further accelerated. During the further course of the start operation, fuel is injected into the combustion chambers of cylinders disposed in the induction phase and the compressed air/fuel mixture, which is disposed in the combustion chambers, is ignited. Here too, the injections can take place alternatively also during the compression phase if the injection pressure is sufficiently high.

According to an advantageous embodiment of the present invention, it is suggested that:

- the inlet and/or outlet valves of a further cylinder, whose piston is disposed ahead of top dead center, are brought into a position corresponding to a compression phase;
- fuel is injected into the combustion chamber of the at least one cylinder disposed in the work phase;

the fuel, which is injected into the at least one cylinder, is ignited in the work phase;

fuel is injected into the combustion chamber of the additional cylinder disposed in the compression phase;

the fuel, which is compressed in the combustion chamber of the additional cylinder, is ignited; and, in the further course of the starting operation, fuel is injected into the combustion chambers of cylinders disposed either in an induction phase or in a compression phase and the fuel, which is compressed in the combustion chambers, is ignited.

By igniting the fuel, which is injected into at least one cylinder in the work phase, a combustion is effected via which a forwardly directed rotational movement is imparted to the crankshaft of the engine. This rotational movement is continued or even accelerated by the ignition of the fuel compressed in the combustion chamber of the additional cylinder.

Finally, in the further course of the starting operation, fuel is injected into the combustion chambers and the fuel, which is compressed in the combustion chambers (that is, at the end of the compression phase or at the start of the work phase) is ignited. In the further course of the starting operation, the fuel is injected in the induction phase or, if the injection pressure is sufficiently high, into the combustion chambers in the compression phase. The starting operation is preferably continued so long until the engine is started and runs automatically in the normal operation.

According to an especially advantageous embodiment of the present invention, it is suggested that:

the inlet and/or outlet valves of two cylinders whose pistons are after top dead center, are brought into a position corresponding to a work phase;

fuel is injected into the combustion chambers of the two cylinders disposed in the work phase; and, the fuel, which is injected into the two cylinders, is ignited in the work phase.

This embodiment permits a double combustion which leads to an especially intense starting acceleration of the crankshaft and therefore to an especially short starting operation.

According to a preferred embodiment of the present invention, it is suggested that the inlet and/or outlet valves of the combustion chambers be brought into the position corresponding to the work phase by means of a camshaft-free control.

Alternatively, it is suggested that the inlet and/or outlet valves of the combustion chambers are brought into the position corresponding to the work phase via such a shift of an inlet camshaft of a variable camshaft actuator device that the inlet valves in an induction phase are opened for a short time only at the beginning. In this way, an earlier inlet closure can be adjusted at the inlet end. In a 4-cylinder engine, two cylinders are thereby disposed at the beginning of the starting operation in the position corresponding to the work phase. Fuel is injected simultaneously into the combustion chambers of these two cylinders and the air/fuel mixture is simultaneously ignited. The double combustion leads to an especially intense starting acceleration of the crankshaft and therefore to an especially short starting operation.

From the method according to the invention, additional degrees of freedom result in the starting operation which can be used in accordance with the invention, inter alia, to initiate a second starting attempt after an unsuccessful first ignition. According to a preferred embodiment of the present invention, it is suggested that, after an unsuccessful first ignition of the fuel, which is injected into at least one cylinder, in the work phase, the method is carried out once again with inverted phases of the individual cylinders. The first ignition is, for example, unsuccessful when the engine does not move or a first compression resistance of the cylinder could not be overcome. In such a case, the method according to the invention is executed once more but with inverted phases of the individual cylinders. This means that the inlet and outlet valves which have been brought into the position corresponding to the work phase in the first start attempt, are now brought into a position corresponding to the induction phase. Likewise, the inlet and outlet valves, which had been brought into a position corresponding to a compression phase, are now brought into a position corresponding to the discharge phase. In the second starting attempt, the injection of fuel into the combustion chambers and the ignition of the fuel, which is compressed in the combustion chambers, takes place in the manner described above.

According to an advantageous further embodiment of the present invention, it is suggested that the pistons of the cylinders are brought into a pregivable start position at the beginning of the start operation. In this way, it can be ensured even for internal combustion engines having fewer than four cylinders, that the piston of at least one cylinder of the engine is disposed in a position optimal for carrying out the starting operation according to the invention. In this way, during the starting operation, a maximum starting acceleration of the crankshaft can be generated with the first combustion. To move the pistons in the cylinders, an electric-motoric starter can be used, which operates on the crankshaft of the engine and rotates the same.

According to a preferred embodiment of the present invention, it is suggested that the fuel, which is compressed in a combustion chamber of a cylinder, is ignited shortly before reaching top dead center of the piston of the particular cylinder toward the end of the compression phase. Alternatively, the compressed fuel can also be ignited shortly after or at the top dead center of the piston of the particular cylinder.

Advantageously, the fuel is injected into the combustion chambers during the starting operation by a presupply pump of the fuel metering system. The presupply pump is, for example, configured as an electric fuel pump driven independently of the internal combustion engine. A presupply pump functions, for example, in a common rail fuel metering system to pump fuel from a fuel supply vessel into a low pressure region of the fuel metering system.

Alternatively, it is suggested that the fuel be injected into the combustion chambers during the starting operation via a high pressure pump of the fuel metering system which is driven independently of the internal combustion engine. In a common rail fuel metering system, the high pressure pump, for example, pumps fuel from the low pressure region of the fuel metering system at high pressure into a high pressure store. From the high pressure store, injection valves branch away via which the fuel is injected from the high pressure store into the combustion chambers of the cylinders. The high pressure pump can, for example, be driven electrically. With the aid of a high pressure pump, especially high injection pressures can be achieved during the starting operation so that the injection time point during the starting operation can be shifted easily into the advanced compression phase up to shortly before reaching top dead center.

To reduce the compression resistance during the starting operation according to the invention, it is suggested in accordance with a preferred embodiment of the present invention that, during the starting operation, in a compression phase of a cylinder of the engine, the corresponding inlet valve of the cylinder is closed delayed or too early. In this way, each run-through compression phase can be shortened in an advantageous manner via a delayed closing of the corresponding inlet valves. These valves are open during the induction phase which takes place in advance of the compression phase. In this way, the crankshaft of the engine can be transferred substantially easier into a rotational movement via the first combustion at the beginning of the starting operation according to the invention and the engine is started. For the same purpose, alternatively, during the starting operation in an induction phase of a cylinder of the engine, the corresponding inlet valve of the cylinder can be closed delayed or too early.

Of special significance is the realization of the method of the invention in the form of a control element which is provided for a control apparatus of an engine, especially of a motor vehicle. A program is stored on the control element which is capable of being run on a computer, especially on a microprocessor, and is suitable for executing the method according to the invention. In this case, the invention is realized by a program stored on the control element so that this control element, which is provided with the program, defines the invention in the same way as the method which the program can carry out. Especially an electric storage medium can be used as a control element, for example, a read-only-memory or a flash memory.

As a further solution of the task of the present invention and proceeding from the multi-cylinder internal combustion of the kind mentioned initially herein, it is suggested that the engine include means for displacing inlet and/or outlet valves of at least one cylinder, whose piston is disposed after top dead center, into a position corresponding to a work phase in advance of the starting operation.

According to an advantageous embodiment of the present invention, it is suggested that the internal combustion engine include a camshaft-free control of inlet and/or outlet valves of the combustion chambers.

Alternatively, it is suggested that the internal combustion engine has, at the inlet end, a variable camshaft positioning device for adjusting an early inlet closure of the inlet valves.

According to a preferred embodiment of the present invention, it is suggested that the internal combustion engine include means for moving the pistons of the cylinders into a pregivable start position at the beginning of the starting operation.

Finally, it is suggested that the fuel metering system has a high pressure pump, which is driven independently of the engine, to build up a fuel injection pressure.

As still another solution of the present invention starting with the control apparatus of the type referred to initially herein, the control apparatus includes means for executing the method of the invention. The control apparatus, to start an internal combustion engine, carries out a drive of components of the engine participating in the starting operation according to the invention, especially components of the fuel metering system and the ignition. The control apparatus obtains the command for starting the internal combustion engine, for example, via the actuation of an ignition key or a starter button.

Further features, application possibilities and advantages of the invention will become apparent from the following description of embodiments of the invention which are illustrated in the drawing. All described or illustrated features define the subject matter of the invention by themselves or in any desired combination independently of their summary in the patent claims or their dependency as well as independently of their formulation or presentation in the description and/or in the drawing.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
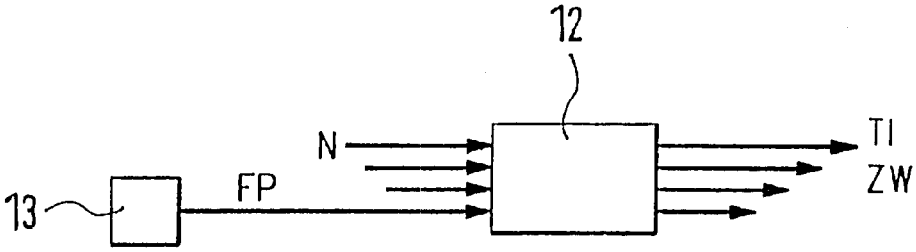
FIG. 1 is a schematic block circuit diagram of an internal combustion engine according to the invention and or a motor vehicle in accordance with a preferred embodiment.
Figure 1:
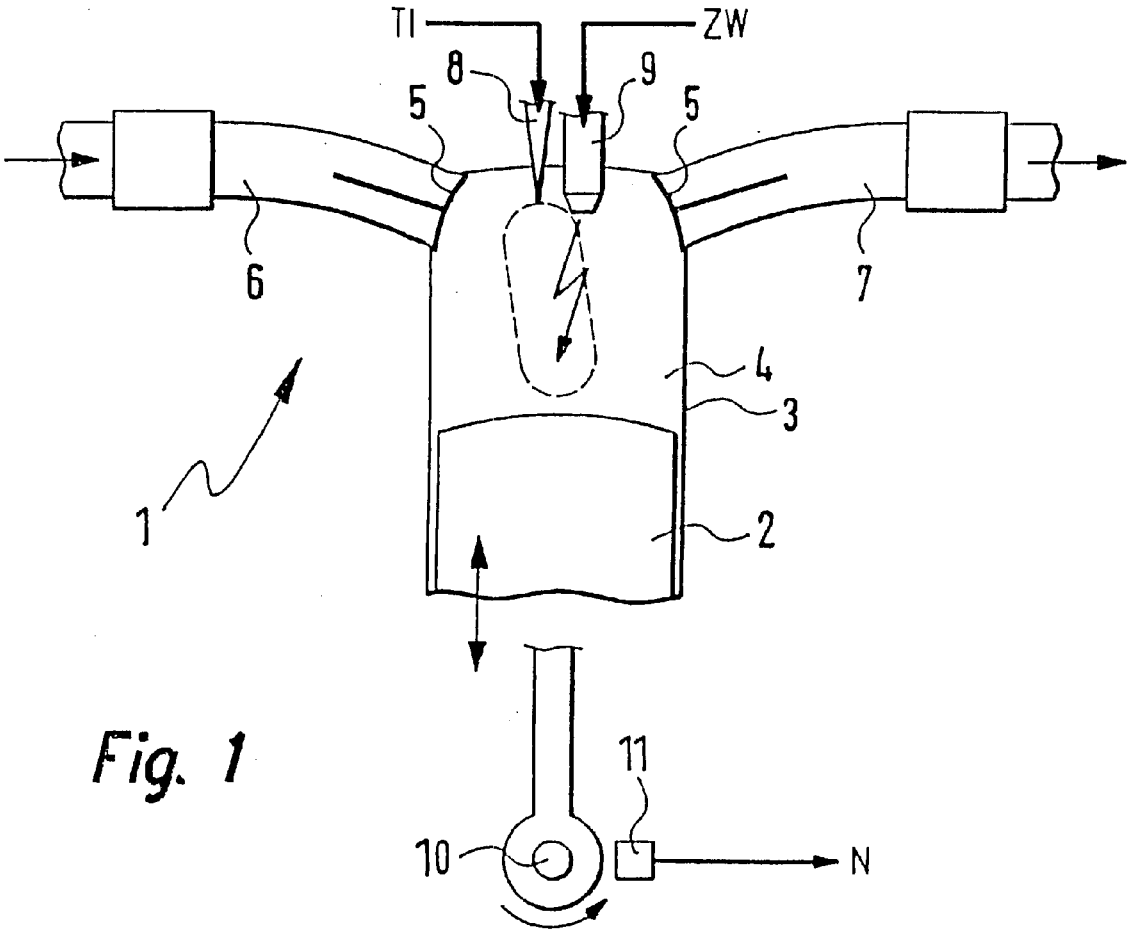

In FIG. 1, an internal combustion engine in its entirety is identified by reference numeral 1. The internal combustion engine 1 includes a piston 2 which is movable back and forth in a cylinder 3. The cylinder 3 includes a combustion chamber 4 to which an intake manifold 6 and an exhaust-gas pipe 7 are connected via valves 5. In addition, an injection valve 8 and a spark plug 9 are assigned to the combustion chamber 4. The injection valve 8 is driven by a signal TI and the spark plug 9 is drivable with a signal ZW.

In a first operating mode, the stratified charge operation of the engine 1, the fuel is injected into the combustion chamber 4 by the injection valve 8 during a compression phase caused by the piston 2 and the injection is locally in the direct vicinity of the spark plug 9 as well as directly in advance of top dead center TDC of the cylinder 3 of before the ignition time point. Then, with the aid of the spark plug 9, the fuel is ignited so that the piston 2 is driven in the following work phase by the expansion of the ignited fuel.

In a second operating mode, the homogeneous operation of the engine 1, the fuel is injected into the combustion chamber 4 by the injection valve 8 during an induction phase caused by the piston 2. The injected fuel is swirled by the simultaneously inducted air and is thereby essentially uniformly (homogeneously) distributed in the combustion chamber 4. Thereafter, the air/fuel mixture is compressed during the compression phase in order to be ignited by the spark plug 9. The piston 2 is driven by the expansion of the ignited fuel.

In stratified operation as in homogeneous operation, rotational movement is imparted to a crankshaft 10 by the driven piston 2 and, via the rotational movement, ultimately the wheels of the motor vehicle are driven. An rpm sensor 11 is assigned to the crankshaft 10 and generates a signal N in dependence upon the rotational movement of the crankshaft 10.

In stratified operation and in homogeneous operation, the fuel is injected into the combustion chamber 4 at a high pressure via the injection valve 8. For this purpose, an electric fuel pump is provided as a presupply pump and a high pressure pump. The high pressure pump is driven by the engine 1 or is driven electromotorically. The electric fuel pump is driven independently of the engine 1 and generates a so-called rail pressure EKP of at least 3 bar and the high pressure pump generates a rail pressure HD of up to approximately 200 bar.

The fuel mass, which is injected by the injection valve 8 into the combustion chamber 4 in stratified operation and in homogeneous operation, is controlled (open loop and/or closed loop) by a control apparatus 12 especially with the view to a low consumption of fuel and/or a low emission of toxic substances. For this purpose, the control apparatus 12 is provided with a microprocessor which, in a control element, especially in a read-only-memory, has a program stored which is suitable to carry out the above-mentioned control (open loop and/or closed loop).

Input signals are applied to the control apparatus 12 and these signals define operating variables of the engine 1 which are measured by sensors. For example, the control apparatus 12 is connected to: an air mass sensor, which is mounted in the intake manifold 6; a lambda sensor mounted in the exhaust-gas pipe 7; and/or an rpm sensor 11. Furthermore, the control apparatus 12 is connected to an accelerator pedal sensor 13 which generates a signal FP which represents the position of the accelerator pedal actuated by the driver.

The control apparatus 12 generates output signals with which the performance of the engine 1 can be influenced via actuators in correspondence to the desired control (open loop and/or closed loop). For example, the control apparatus 12 is connected to the injection valve 8 and to spark plug 9 and generates the signals TI, ZW required for driving the injection valve and spark plug.

Figure 2:
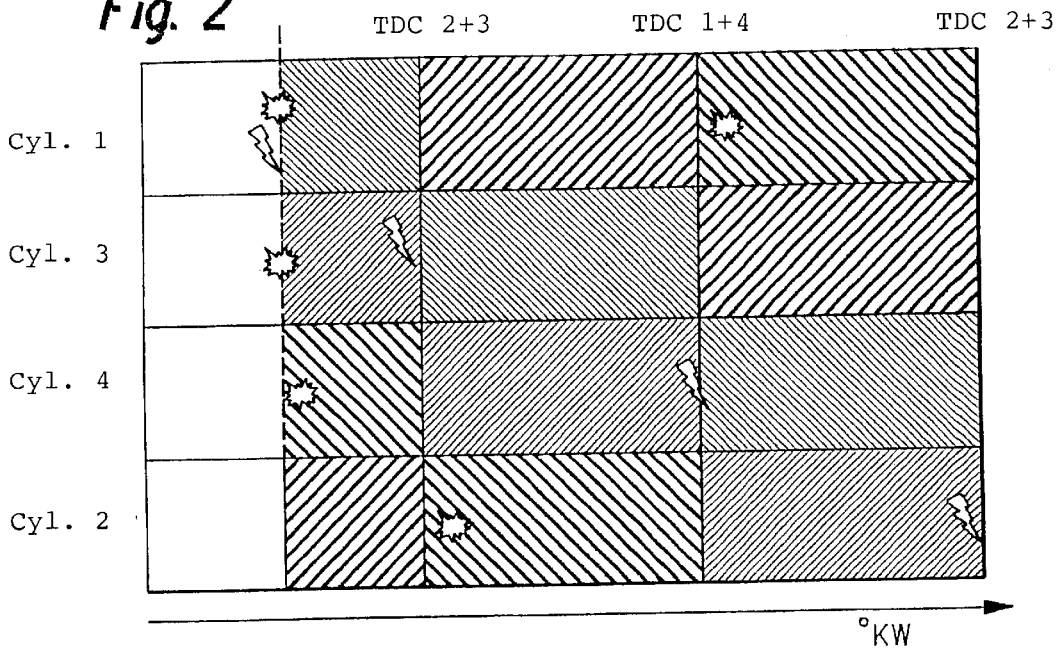
FIG. 2 is a schematic diagram of a first embodiment of a method according to the invention for starting the internal combustion engine of FIG. 1.
Figure 3:
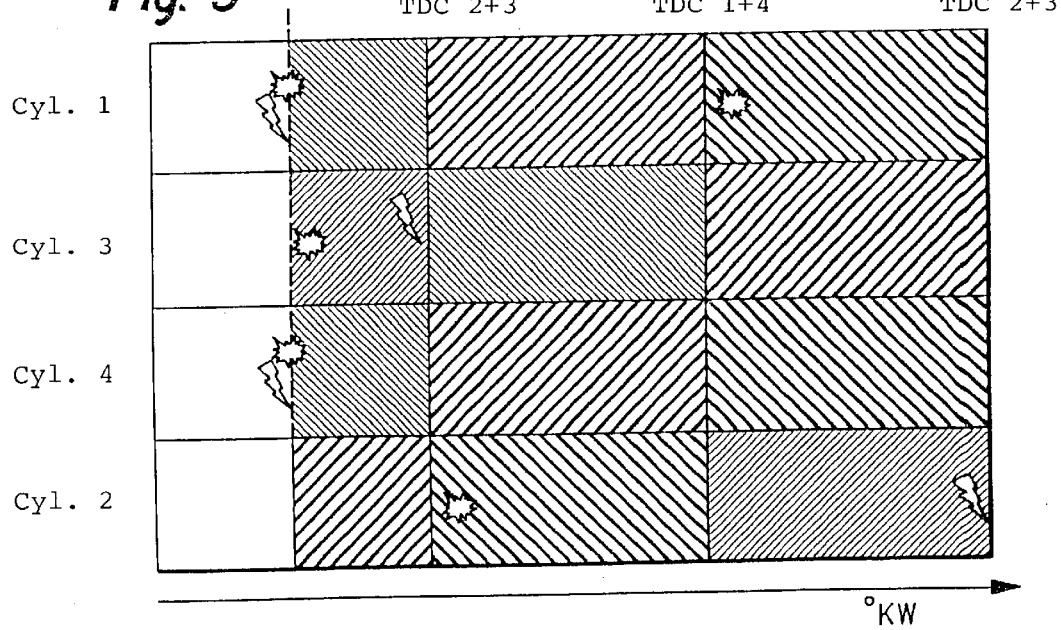
FIG. 3 is a schematic diagram of a second embodiment of a method according to the invention for starting the engine of FIG. 1; and, FIG. 4 is a schematic diagram of a third embodiment of a method according to the invention for starting the internal combustion engine of FIG. 1.
Figure 3:
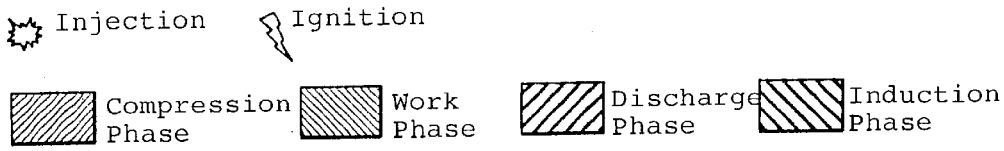
Figure 4:
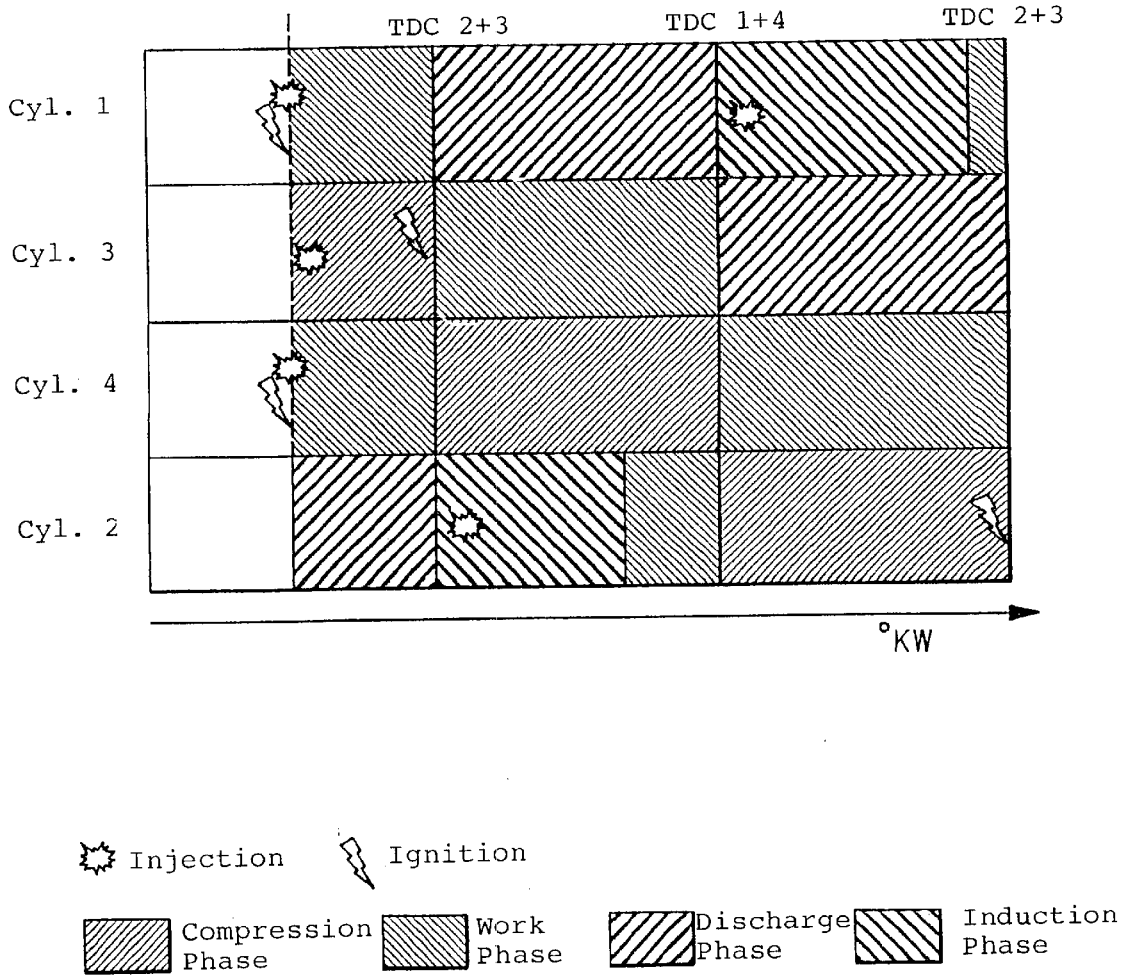

In FIGS. 2 to 4, three different methods of the invention are shown schematically in the form of diagrams for starting a 4-cylinder internal combustion engine 1. The individual lines of the diagram refer respectively to the indicated cylinder 3 of the engine 1. The different cylinders 3 are characterized by numbers. The individual gaps of the diagrams refer to the phases of strokes within which the piston 2 of the corresponding cylinder 3 is located. Each of the pistons 2 can be in an induction phase, a compression phase, a work phase or a discharge phase. The transitions between the individual phases are characterized by the top dead center TDC of the pistons 2. The horizontal axis along the phases of the pistons 2 defines a rotational angle °KW of the crankshaft 10. The position of the engine 1 in advance of the start is shown by the broken line, that is, the position at standstill of the engine 1.

In the method described hereinafter and shown in the figures, the rpm sensor 11 is configured as an absolute angle transducer. This means that the rpm sensor 11 at any time, especially also after a standstill of the engine 1, generates the rotational angle °KW and transmits the same to the control apparatus 12. In this way, before the beginning of the starting operation, the position of the piston 2 in the cylinders 3 can be determined. Alternatively, a necessary rotation can be imparted to the crankshaft 10 by an electro-motoric starter so that the rpm sensor 11 can signal the position of the piston 2.

In the method of FIG. 2, and for an engine 1 at standstill, the cylinder number 1 is in its work phase (combustion chamber 4 closed, position of the piston 2 after TDC). At the beginning of the starting operation, fuel is injected into the combustion chamber 4 of the cylinder 1. In the event that the high pressure pump is driven by the engine 1, the injection takes place only under rail pressure EKP of the electric fuel pump. Otherwise (the high pressure pump is driven independently of the internal combustion engine 1), the fuel is injected into the combustion chamber 4 under high pressure for the purpose of mixture preparation. Then, the injected fuel is ignited. This has a first combustion as a consequence via which the crankshaft 10 is set into rotational movement which is directed forwardly.

Directly thereafter, fuel is injected into cylinder number 3. This cylinder is in its compression phase because of the closed valves 5 and the piston 2 moving upwardly. The injection time point (if the injection pressure is sufficiently high) can be displaced into the advancing compression phase until shortly before reaching top dead center TDC. A sufficiently high injection pressure can, for example, be generated by means of a high pressure pump driven independently of the engine 1. Shortly before or after reaching top dead center TDC, the compressed air/fuel mixture is ignited and a second combustion takes place via which the rotational movement of the crankshaft 10 is further accelerated.

The additional injections, ignitions and positioning of the valves 5 are shown in the diagram for the example of cylinder 4 and of cylinder 2. Accordingly, the further injections take place during the induction phase of the particular cylinder number 3. Alternatively, the additional injections take place also during the compression phase if the injection pressure is sufficiently high. The additional ignitions take place toward the end of the compression phase shortly before or shortly after reaching top dead center TDC.

The inlet and outlet valves 5 of the combustion chamber 4 are displaced by means of a camshaft-free control. For this purpose, each inlet and outlet valve 5 is equipped with its own positioning element. In this way, the valves 5 can be opened or closed independently and freely insofar as the valve free path permits. In this way, a change can be made from an induction phase into a work phase and vice versa. In a corresponding manner, the change from a compression phase into a discharge phase and vice versa is possible. Because of the camshaft-free control of the valves 5, the inlet and/or outlet valves 5 at the beginning of the start operation can be brought into a pregiven position in order to provide optimal conditions for starting the engine 1 without an electric-motoric starter.

Furthermore, after an unsuccessful first starting attempt, the phases of all cylinders 3 can be inverted in a simple manner for a second start attempt, that is, a switchover takes place between compression phase and discharge phase and between work phase and induction phase. An unsuccessful first start attempt is, for example, present when the engine 1 does not move or the first compression resistance could not be overcome. In the embodiment of FIG. 2, the work phase is present for the second start attempt for the cylinder 4 at the beginning of the starting operation. Fuel is injected into the cylinder number 2 which is then in the compression phase. In the further course of the starting operation, fuel is injected into the cylinders 1 and 2 and is ignited.

To reduce the compression resistance during the starting operation according to the invention, each run-through compression phase can be suitably shortened by a delayed or advanced closing of the corresponding inlet valves 5 (these are opened during the induction phase which takes place ahead of the compression phase). The method described is applicable with appropriate modifications also to internal combustion engines 1 having more than four cylinders.

In the method according to FIG. 3, the cylinder 1 and the cylinder 4 are in the work phase because of a closure of the valves 5. Fuel is injected into both cylinders 3 simultaneously and is ignited. The double combustion leads to an intense starting acceleration of the crankshaft 10 and therefore to an especially short starting operation. Because of the double combustion, sufficient reserves are present at the beginning of the start operation in order to reliably overcome possible friction resistances or compression resistances of the engine 1.

All further injections, ignitions and valve positionings correspond to those of the invention of FIG. 1 and can be taken directly from the diagram in FIG. 3. It is understood that also in this embodiment of the method of the invention, the compression resistances can be reduced in that each run-through compression phase is suitably shortened by delayed or advanced closure of the corresponding inlet valves 5. With appropriate modifications, this embodiment of the method according to the invention can also be applied to internal combustion engines 1 having more than four cylinders.

The embodiment of the method according to the invention shown in FIG. 4 can be carried out in an internal combustion engine 1 which has a variable camshaft positioning device at the inlet for adjusting an early inlet closure of the inlet valves 5. The cylinder 1 is in its work phase at the beginning of the starting operation. For cylinder 4, which is parallel in the piston movement to cylinder 1, a closed combustion chamber 4 is likewise present. For this purpose, at the beginning of the starting operation or for an engine 1 running to standstill, the inlet camshaft is so displaced that the inlet valves 5 in the induction phase are opened only at the start for a short time (early inlet closure). In this way, at the beginning of the start operation, in addition to cylinder 1, also cylinder 4 is quasi in its work phase. In a first stroke, fuel is injected simultaneously into both cylinders 3 and ignited. The double combustion again effects an intense starting acceleration of the crankshaft 10 and therefore a short starting operation.

Thereafter, fuel is injected into cylinder 3. Cylinder 3 is in its compression phase because of the closed valves 5 and the upwardly moving cylinder 2. The injection time point in the cylinder 3 can, alternatively (if the injection pressure is sufficiently high), be shifted into the advancing compression phase shortly before reaching top dead center. Shortly before or shortly after reaching top dead center, the compressed air/fuel mixture is ignited and a second combustion takes place which leads to an acceleration of the rotational movement of the crankshaft 10.

The additional injections, ignitions and valve positionings can be taken directly from the diagram. According to the diagram, the injections take place during the induction phase of the particular cylinder 3. Alternatively, the injections can also take place during the compression phase if the injection pressure is sufficiently great.

After rotation start of the crankshaft 10, the inlet camshaft is brought back into a relative position corresponding to the operating point of the engine 1. For this purpose, the diagram in FIG. 4 shows the case of a relatively small positioning speed. Accordingly, an early inlet closure is present in the second and third induction phases. This is, however, insignificant for the charge quantities necessary in the start phase.

The described embodiment of the method in accordance to the invention is, with corresponding modifications, also applicable for engines 1 having more than four cylinders. In internal combustion engines 1 having less than four cylinders, the case can occur that, at the beginning of the starting operation, none of the pistons 2 is disposed in its work phase. In this case, a piston 2, however, is in its induction phase. Then, the inlet camshaft can be so shifted that the cylinder 2 transfers from the induction phase quasi into the work phase. In this case too, the engine 1 can be started without an electric-motoric starter.

According to another embodiment of the present invention (not shown), the inlet camshaft is not shifted at the beginning of the starting operation, that is, the cylinder 4 in FIG. 4 remains in its induction phase. As a consequence, fuel is injected only into cylinder 1 and ignited. For an unsuccessful ignition (the internal combustion engine 1 does not move or a compression resistance could not be overcome), a second start attempt is carried out. For this purpose, the inlet camshaft is shifted in the manner as presented in the description of FIG. 4. In this way, the work phase is present for the cylinder 4 at the beginning of the starting operation. Injections and ignitions take place (while excluding cylinder 1 at the beginning of the starting operation) in correspondence to the procedure given in the embodiment of FIG. 4.

What is claimed is:

1. A method for starting a multi-cylinder direct-injecting internal combustion engine including an engine for a motor vehicle without the aid of a starter motor, each cylinder of the engine running sequentially through an induction phase, a compression phase, a work phase and a discharge phase during operation of the engine, the method comprising the steps of:

in advance of the starting operation, bringing at least one of the inlet and outlet valves of each of at least two cylinders, whose pistons are disposed in respective locations after top dead center, into a position corresponding to the work phase;

injecting fuel into the combustion chambers of said two cylinders and igniting said fuel thereby triggering said starting operation; and, after an unsuccessful first ignition of fuel injected into at least two cylinders in the work phase, the method is carried out once more with inverted phases of the individual cylinders wherein the inlet and outlet valves of said individual cylinders are driven so that cylinders which were previously in said intake phase are now in said work phase and vice versa and individual cylinders which were previously in said compression phase are now in said discharge phase and vice versa.

2. The method of claim 1, comprising the further step of utilizing a camshaft-free control to bring said valves into said position corresponding to said work phase.

3. The method of claim 1, comprising the further step of bringing said valves of said cylinders into the position corresponding to said work phase via such an adjustment of an inlet camshaft of a variable camshaft actuator so that the inlet valves are opened for a short time only at start in said induction phase.

4. The method of claim 1, comprising the further step of bringing the pistons of the cylinders into a pregivable start position at the beginning of the starting operation.

5. The method of claim 1, wherein the fuel, which is compressed in a combustion chamber of a cylinder, is ignited shortly before reaching of the top dead center point of the piston of the particular cylinder toward the end of the compression phase.

6. The method of claim 1, wherein the fuel is injected into the combustion chambers during the starting operation by a presupply pump of the fuel metering system.

7. The method of claim 1, wherein the fuel is injected into the combustion chambers during the starting operation by a high pressure pump of the fuel metering system driven independently of the engine.

8. The method of claim 1, wherein, during the starting operation, in a compression phase of a cylinder of the engine, the corresponding inlet valve of the cylinder is closed delayed after the previous intake phase so that the compression phase, wherein both the inlet and outlet valves are closed, is shortened.

9. The method of claim 1, wherein, during the starting operation in an induction phase of a cylinder of the engine, the corresponding inlet valve of the cylinder is closed delayed after the previous compression phase so that the intake phase, wherein both the inlet and outlet valves are closed, is shortened.

10. A control element including a read-only-memory or flash memory, for a control apparatus of an internal combustion engine including an engine of a motor vehicle, comprising a program stored on said control element which can be run on a computer apparatus including on a microprocessor and is suitable for carrying out a method for starting a multi-cylinder direct-injecting internal combustion engine including an engine for a motor vehicle without the aid of a starter, each cylinder of the engine running sequentially through an induction phase, a compression phase, a work phase and a discharge phase during operation of the engine, the method comprising the steps of:

in advance of the starting operation, bringing at least one of the inlet and outlet valves of each of at least two cylinders, whose pistons are disposed in respective locations after top dead center, into a position corresponding to the work phase;

injecting fuel into the combustion chambers of said two cylinders and igniting said fuel thereby triggering said starting operation; and, after an unsuccessful first ignition of fuel injected into at least two cylinders in the work phase, the method is carried out once more with inverted phases of the individual cylinders wherein the inlet and outlet valves of said individual cylinders are driven so that cylinders which were previously in said intake phase are now in said work phase and vice versa and individual cylinders which were previously in said compression phase are now in said discharge phase and vice versa.

11. A multi-cylinder direct-injecting internal combustion engine including an engine of a motor vehicle, the engine comprising:

a detecting device for determining the positions of at least two pistons of two cylinders of said engine;

positioning means for bringing at least one of the inlet and outlet valves of each of at least two cylinders, whose pistons are disposed in respective locations after top dead center, into a position corresponding to the work phase in advance of the starting operation;

a fuel metering system for injecting fuel into the combustion chambers of said two cylinders and means for igniting said fuel thereby triggering said starting operation of said engine without the aid of a starter; each cylinder of the engine running sequentially through an induction phase, a compression phase, a work phase and a discharge phase during operation of the engine; and, a control apparatus including means for carrying out a method for starting said engine including the steps of:

in advance of the starting operation, bringing at least one of the inlet and outlet valves of each of at least two cylinders, whose pistons are disposed in respective locations after top dead center, into a position corresponding to the work phase;

injecting fuel into the combustion chambers of said two cylinders and igniting said fuel thereby triggering said starting operation; and, after an unsuccessful first ignition of fuel injected into at least two cylinders in the work phase, the method is carried out once more with inverted phases of the individual cylinders wherein the inlet and outlet valves of said individual cylinders are driven so that cylinders which were previously in said intake phase are now in said work phase and vice versa and individual cylinders which were previously in said compression phase are now in said discharge phase and vice versa.

12. The multi-cylinder direct-injecting engine of claim 11, wherein said positioning means is configured as a camshaft-free control of said valves.

13. The multi-cylinder direct-injecting engine of claim 11, wherein said positioning means is configured as a variable camshaft actuator, which is assigned to the inlet end, for adjusting an early closure of the inlet valves to inflow.

14. The multi-cylinder direct-injecting engine of claim 11, further comprising means for moving the piston of the cylinder into a pregivable start position at the beginning of the starting operation.

15. The multi-cylinder direct-injecting engine of claim 11, wherein said fuel metering system includes a high pressure pump, which is driven independently of said engine, for building up a fuel injection pressure.

16. A control apparatus of a multi-cylinder internal combustion engine including an engine of a motor vehicle, the engine including: a detecting device for determining the position of a piston in a cylinder of the engine; a fuel metering system for injecting fuel into a combustion chamber of at least one cylinder, whose piston is disposed in a work phase; and, means for igniting an air/fuel mixture disposed in the combustion chamber of said at least one cylinder in order to thereby trigger a starting operation of said engine without the aid of a starter; each cylinder of the engine running sequentially through an induction phase, a compression phase, a work phase and a discharge phase during operation of the engine, said control apparatus comprising means for carrying out a method for starting said engine including the steps of:

in advance of the starting operation, bringing at least one of the inlet and outlet valves of each of at least two cylinders, whose pistons are disposed in respective locations after top dead center, into a position corresponding to the work phase;

injecting fuel into the combustion chambers of said two cylinders and igniting said fuel thereby triggering said starting operation; and, after an unsuccessful first ignition of fuel injected into at least two cylinders in the work phase, the method is carried out once more with inverted phases of the individual cylinders wherein the inlet and outlet valves of said individual cylinders are driven so that cylinders which were previously in said intake phase are now in said work phase and vice versa and individual cylinders which were previously in said compression phase are now in said discharge phase and vice versa.

* * * * *

UNITED STATES PATENT AND TRADEMARK OFFICE

CERTIFICATE OF CORRECTION

PATENT NO. : 6,718,928 B2 
DATED : April 13, 2004
INVENTOR(S) : Gerhard Brueggen, Nikolaus Benninger and Udo Sieber It is certified that error appears in the above-identified patent and that said Letters Patent is hereby corrected as shown below:

Title page,
Item [30], Foreign Application Priority Data,
-- Apr. 22, 2000 (DE) …….. 100 20 104 -- should be inserted before
"[51] Int. Cl.[7] …… F02N 17/00".

Signed and Sealed this

Twenty-ninth Day of June, 2004

JON W. DUDAS
*Acting Director of the United States Patent and Trademark Office*